US007938314B1

(12) United States Patent
Benesh

(10) Patent No.: US 7,938,314 B1
(45) Date of Patent: May 10, 2011

(54) REMOTELY OPERABLE MAILBOX SYSTEM AND ASSOCIATED METHOD

(76) Inventor: Helen Benesh, Trappe, MD (US)

( * ) Notice: Subject to any disclaimer, the term of this patent is extended or adjusted under 35 U.S.C. 154(b) by 0 days.

(21) Appl. No.: 12/541,238

(22) Filed: Aug. 14, 2009

Related U.S. Application Data

(60) Provisional application No. 61/189,062, filed on Aug. 15, 2008.

(51) Int. Cl.
*B65G 11/04* (2006.01)

(52) U.S. Cl. ..... 232/45; 232/29; 232/34; 340/5.64; 340/5.73

(58) Field of Classification Search ..... 232/45, 232/44, 17, 34–36, 29, 33, 38; 220/211, 220/528; 206/514; 49/31; 340/545.6, 569, 340/5.61, 5.64, 5.73
See application file for complete search history.

(56) References Cited

U.S. PATENT DOCUMENTS

| | | | | |
|---|---|---|---|---|
| 2,465,935 | A * | 3/1949 | Scalia | 340/569 |
| 4,896,827 | A * | 1/1990 | Economou | 232/17 |
| 5,954,264 | A | 9/1999 | Keller | |
| 6,513,706 | B1 * | 2/2003 | Kuca | 232/35 |
| 6,629,634 | B2 * | 10/2003 | Simmons | 232/45 |
| 6,698,651 | B1 | 3/2004 | Green | |
| 6,957,767 | B2 * | 10/2005 | Aupperle et al. | 232/45 |
| 6,997,373 | B2 * | 2/2006 | Flores | 232/29 |
| 7,004,380 | B2 | 2/2006 | Gunvaldson | |
| 7,222,779 | B1 * | 5/2007 | Pineda-Sanchez et al. | 232/36 |
| 7,249,705 | B2 * | 7/2007 | Dudley | 232/47 |
| 7,398,915 | B1 * | 7/2008 | Pineda-Sanchez et al. | 232/36 |
| 2006/0214770 | A1 * | 9/2006 | Capouch et al. | 340/5.73 |

* cited by examiner

*Primary Examiner* — William L. Miller

(57) ABSTRACT

A wireless outdoor mailbox actuating system preferable includes a lockable outdoor mailbox having a housing, a plurality of operating components dynamically attached to the housing and a mechanism for synchronously toggling the operating components between first and second associated positions respectively. The front door of the mailbox has an elongated slot that is large enough to receive for example, a DVD and a collection of mail. A remote controller is communicatively linked to a receiver and to a main controller to remotely activate the front door actuating mechanism, tray displacing mechanism and flag raising mechanism, respectively. Selected ones of such mechanisms may be synchronously linked together to allow a user to retrieve mailbox contents without the need to reach into the mailbox. The system additionally provides an effective and secure means of preventing unauthorized access to private mail inside the mailbox.

19 Claims, 11 Drawing Sheets

REMOTELY OPERABLE MAILBOX SYSTEM AND ASSOCIATED METHOD

CROSS REFERENCE TO RELATED APPLICATIONS

This application claims the benefit of U.S. Provisional Application No. 61/189,062, filed Aug. 15, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to mailboxes and, more particularly, to a remotely operable mailbox system for providing users with an effective means of preventing access of private mail to unauthorized individuals and with a convenient means of retrieving deposited mail from a mailbox without exiting their vehicle.

2. Prior Art

The standard, rural mailbox has a rectangular bottom panel and a U-shaped roof portion extending the length of the bottom panel. It has a back panel at one end and a door at the other end in the shape of the U-shaped roof portion. When removing mail from the conventional mailbox, the recipient must grope into the box to access the mail. If the recipient drives up to the box to retrieve the mail, they must usually extend their body through the vehicle window to get to the mailbox. This is inconvenient and uncomfortable for the recipient, and can be dangerous in certain situations. For example, if the brake in the recipient's car or truck is not properly applied, or the transmission accidentally disengages from "park" while the mail is being retrieved, the recipient may be in a precarious position, hanging out the vehicle's window and with his or her hand engaged inside the mailbox. Injury to the mail recipient and damage to the vehicle, the mailbox or surrounding property, are likely results of such a situation.

Accordingly, a need remains for a remotely operable mailbox system in order to overcome the above-noted shortcomings. The present invention satisfies such a need by providing a system that is convenient and easy to use, is durable yet lightweight in design, is versatile in its applications, and provides owners of outdoor mailboxes with an effective deterrent to mail and identity theft.

BRIEF SUMMARY OF THE INVENTION

In view of the foregoing background, it is therefore an object of the present invention to provide an apparatus for a wireless outdoor mailbox actuating system for effectively deterring mail and identity theft. These and other objects, features, and advantages of the invention are provided by a remotely operable mailbox system and associated method.

In a preferred embodiment of the present invention, a wireless outdoor mailbox actuating system for effectively deterring mail and identity theft may preferably include a lockable outdoor mailbox having housing, a plurality of operating components dynamically attached to the housing and mechanism for synchronously toggling the operating components between first and second associated positions respectively.

The first operating component may preferably be freely biased between the first and the second associated positions while the second operating component may preferably remain seated inside the housing. Further, the second operating component may preferably be freely reciprocated along the first and second associated positions while the first operating component remains at the second associated position. Additionally, a third operating component may be independently biased between the first and second associated positions regardless of whether the first and second operating components are disposed at the first or second associated positions. The first operating component may additionally be provided with an elongated slot for receiving mail into the housing.

In one embodiment, the synchronously toggling mechanism may preferably have a remote controller for generating and transmitting an instruction signal upon receiving a user input. The mechanism may further have a receiver situated inside the outdoor mailbox and preferably in wireless communication with the remote controller and a main controller electrically coupled directly to the receiver. In this way, the main controller may preferably generate and transmit an operating signal upon receiving the instruction signal from the remote controller such that the operating signal is communicated to the first, second and third operating components respectively.

In one embodiment, the operating components may preferably have a front door pivotally mated to the housing with a front door actuating mechanism connected such that the first and second positions of the front door may preferably be defined at horizontal and vertical positions respectively. Further, the front door actuating mechanism may preferably have a lock coupled to the front door and the housing such that the lock may be disengaged from the housing when the front door is pivoted to the horizontal position.

In one embodiment, the operating components may further have a tray which may preferably have a first and second pivotally mated tray members oriented along an end-to-end pattern defined parallel to a longitudinal length of the housing. A tray displacing mechanism may additionally be connected to the tray such that the first and second positions of the tray are defined interior and exterior of the housing respectively.

The tray displacing mechanism may further include a first set of linear guide tracks formed along a bottom surface of the first and second tray members; a first set of gears rotatably engaged with the first set of linear guide tracks; and a first motor electrically mated to the first set of gears. This arrangement may preferably allow the first motor to be responsive to the operating signal of the main controller and thereby causes the first set of gears to rotate along the first set of guide tracks such that each of the first and second tray members are linearly reciprocated between the first and second associated positions respectively.

In another embodiment, the tray displacing mechanism may further include first and second sensors positioned at the first tray member and the lock respectively; a second guide track connected to the lock; and a second gear rotatably mated to the second guide track. The first sensor may preferably be communicatively linked to the second sensor such that the second sensor may notify the main controller to activate the second motor after the first sensor drops below the second sensor while traveling away from the housing. This arrangement may preferably cause the second gear to rotate and thereby linearly displace the lock away from the housing while the second sensor is disposed below the first sensor. In this way, the first tray member is pivotally urged upward to a horizontal position from a vertical position and thereby linearly retracts back into the housing upon rotational movement of the first set of gears respectively. This operation ensures that the first tray may not hang down in a vertical position and allow the mail deposited on the first tray in the mailbox to slip to the ground when the first and second tray is extended while a user is retrieving his mail.

In another embodiment, the operating components may further have a flag and a flag raising mechanism connected to the flag such that the first and second associated positions of the flag are defined at horizontal and vertical positions respectively. The flag raising mechanism may further have a rotating driven gear monolithically formed at a distal end of the flag; a rotating drive gear interconnected to the driven gear; and a motor communicatively coupled to the main controller and the drive gear respectively. Further, the drive gear may preferably be caused to rotate along clockwise and counter clockwise rotational directions and thereby causing the driven gear to rotate along counter clockwise and clockwise directions respectively thus causing the flag to be pivoted between horizontal and vertical positions as the driven gear is rotated respectively.

The invention may further include a method of utilizing a wireless outdoor mailbox actuating system and thereby effectively deterring mail and identity theft. Such a method may include the chronological steps of providing a lockable outdoor mailbox having housing and a plurality of operating components dynamically attached to the housing. The method may further include synchronously toggling the operating components between first and second associated positions respectively by performing the following chronological steps of freely biasing the first operating component between the first and the second associated positions while the second operating component remains seated inside the housing, thereby further freely reciprocating the second operating component along the first and second associated positions while the first operating component remains at the second associated position and further independently biasing the third operating component between the first and second associated positions regardless of whether the first and second operating components are disposed at the first or second associated positions respectively. In addition, the method may further include the first operating component to be provided with an elongated slot for receiving mail into the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
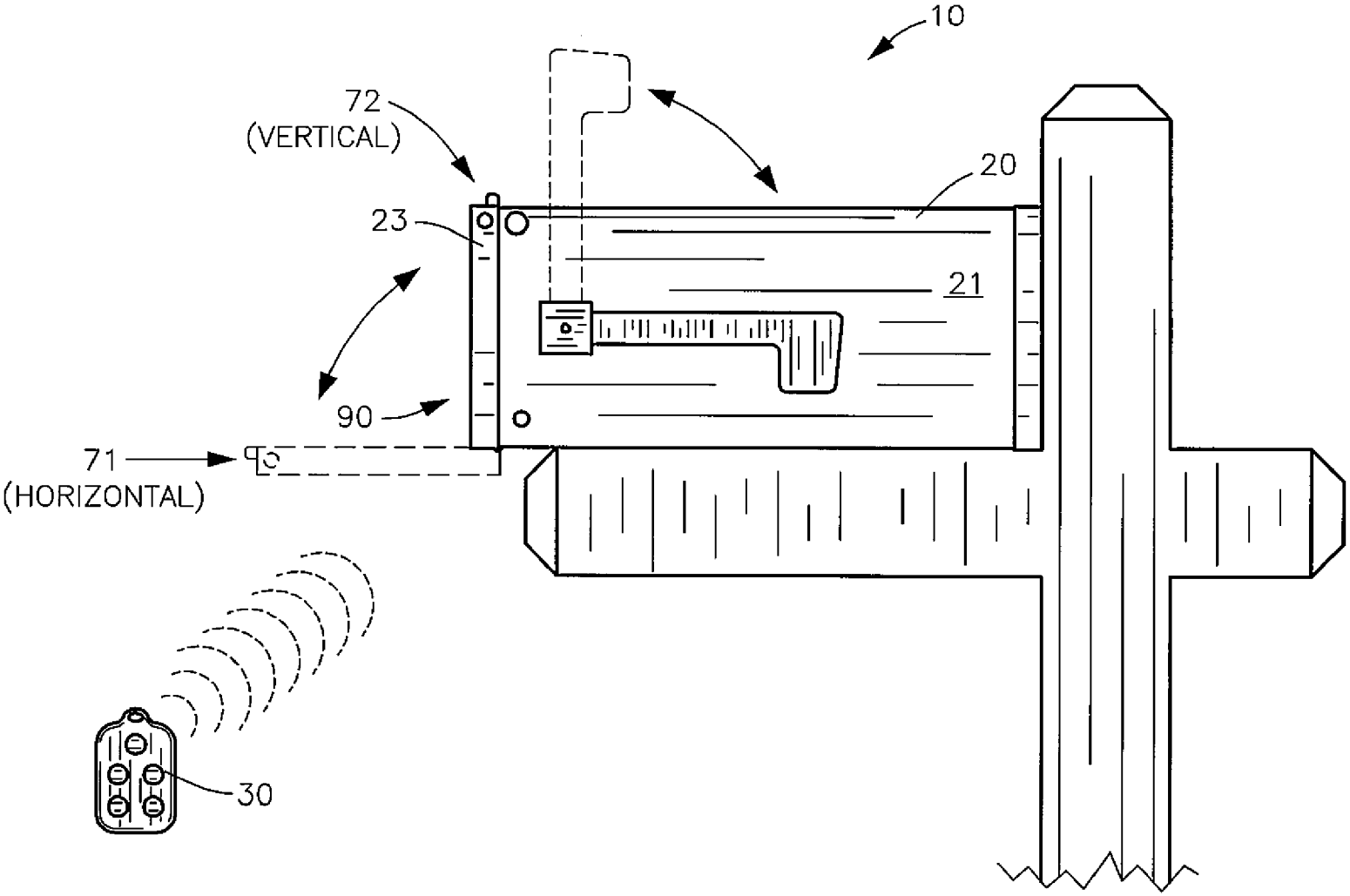
FIG. 1 is a left side elevational view showing a remotely operable mailbox system, in accordance with the present invention.
Figure 2:
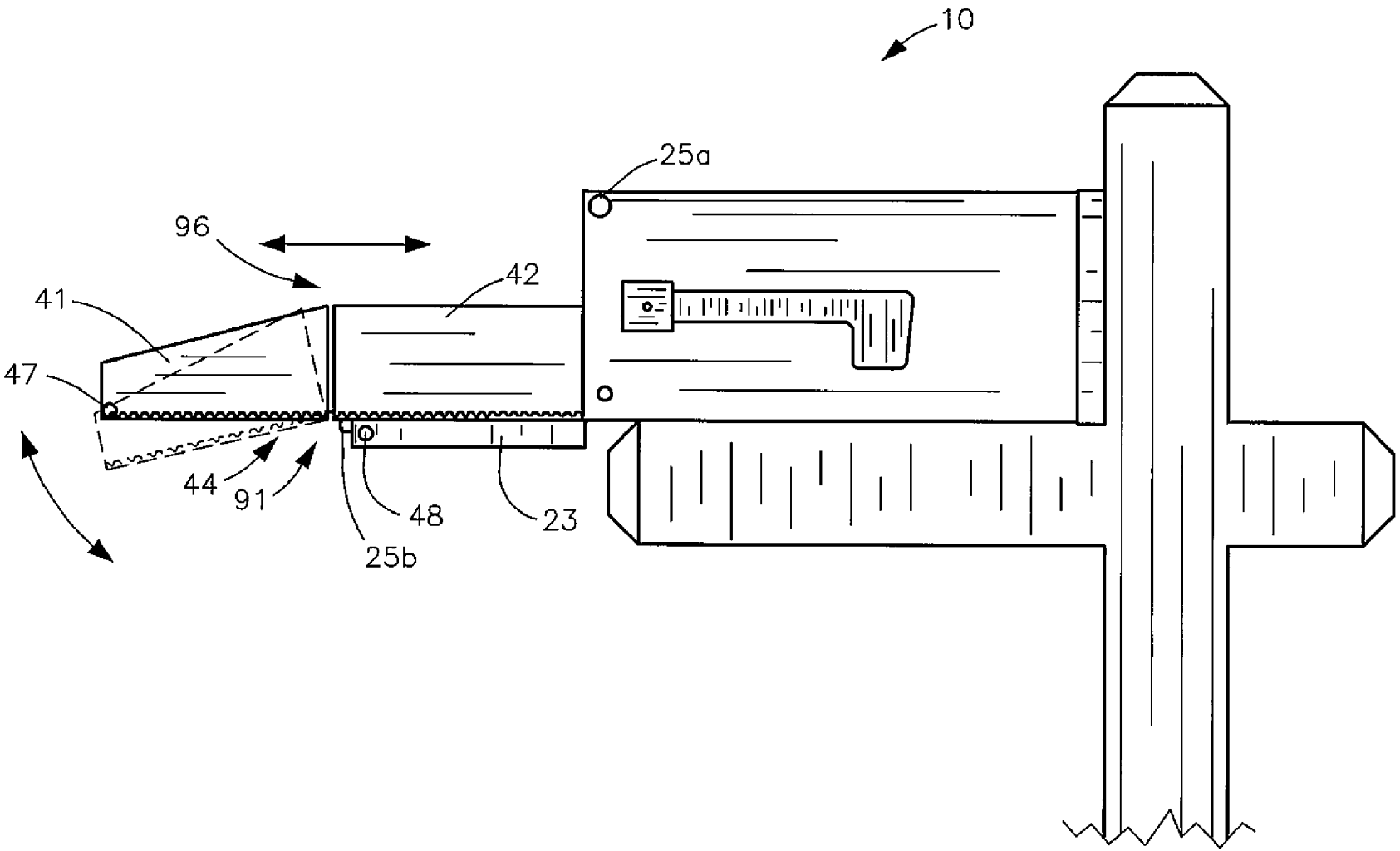
FIG. 2 is a left side elevational view showing the first and second tray members in an extended position.
Figure 3:
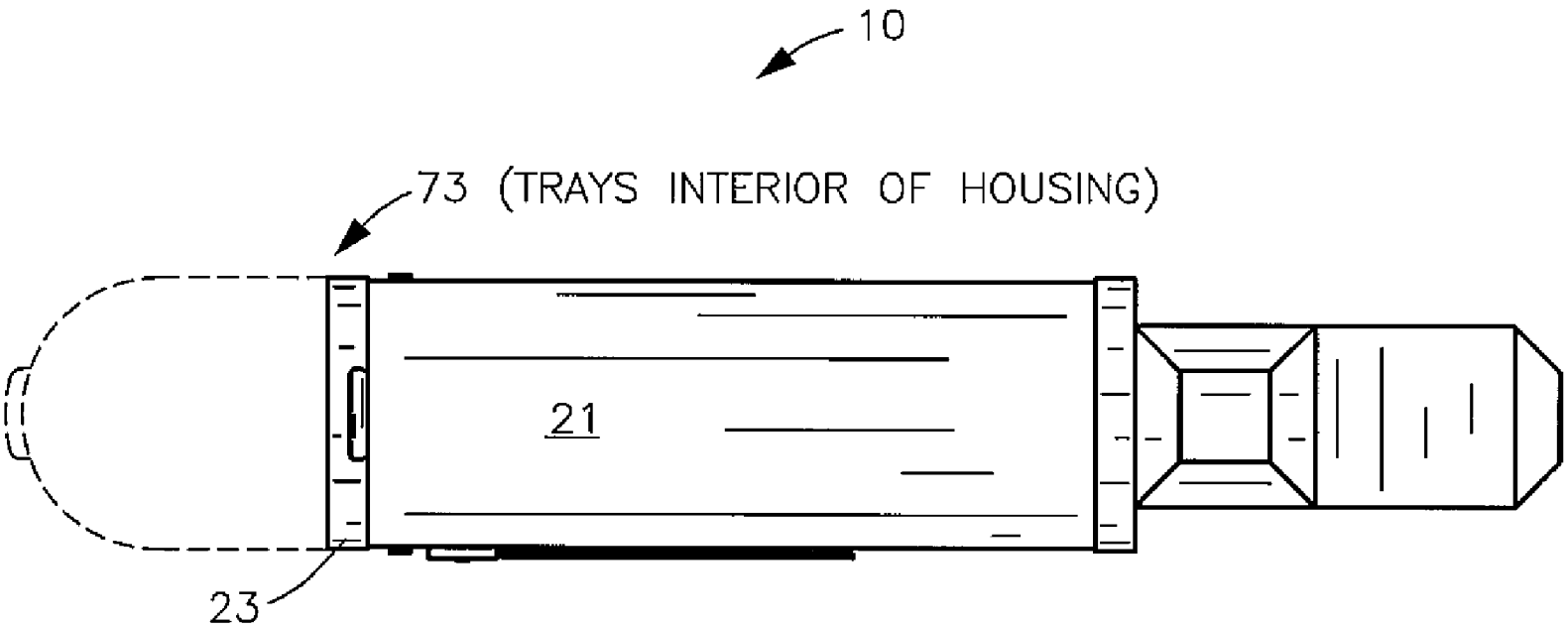
FIG. 3 is a top plan view of the system shown in FIG. 1.
Figure 4:
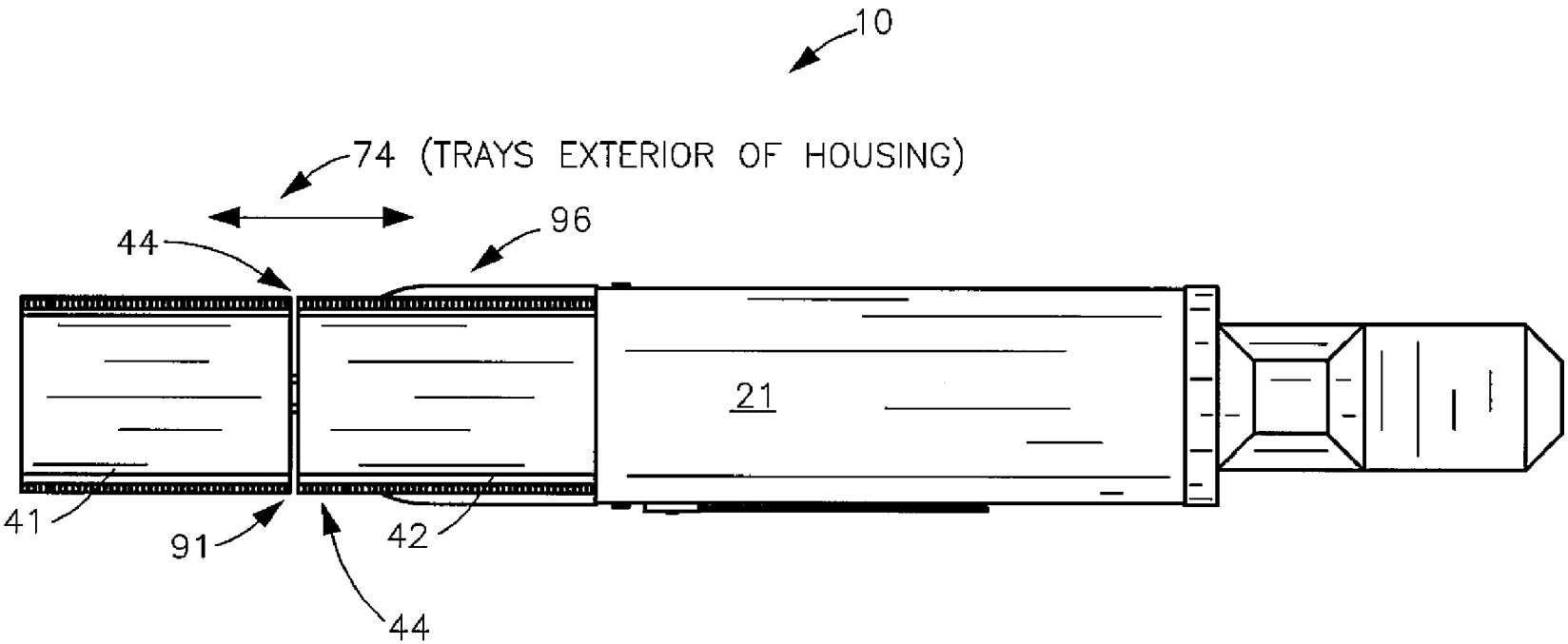
FIG. 4 is a top plan view of the system shown in FIG. 2.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-11 by reference numeral 10 and is intended to provide a wireless outdoor mailbox actuating system for effectively deterring mail and identity theft. In a preferred embodiment, the wireless outdoor mailbox actuating system 10 may preferably include a lockable outdoor mailbox 20 having a housing 21, a plurality of operating components 90, 91, 92 dynamically attached to the housing 21 and a mechanism 95 for synchronously toggling the operating components 90, 91, 92 between first and second associated positions respectively. Such operating components are associated with the front door 23, tray 96, flag 50 and their respective operating mechanisms (described hereinbelow)

It is noted that the first and second positions of the first operating component 90 is preferably defined at raised and lowered positions, as perhaps best shown in FIGS. 1, 2, 5 and 6. The first and second positions of the second operating component 91 is preferably defined at extended and retracted positions, as perhaps best shown in FIGS. 8 and 9. The first and second positions of the first operating component 92 is preferably defined at raised and lowered positions, as perhaps best shown in FIGS. 1, 2, 7.

The outdoor mailbox 20 my preferably be produced of a durable, heavy duty material, like metal or plastic to ensure that it is not easily damaged by rain, snow, ice or heat from the sun. The outdoor mailbox 20 may be oval-shaped with a flattened base and may be offered in a vast array of colors and styles to appeal to individual tastes, as is obvious to a person of ordinary skill in the art.

Referring to FIGS. 1-6 in more detail, the first operating component 90 may be freely biased between the first (raised) and the second (lowered) associated positions while the second operating component 91 may remain seated inside the housing 21 (at the respective second position). Further, the second operating component 91 may be freely reciprocated along its first (extracted) and second (retracted) positions while the first operating component 90 remains at its second (lowered) associated position.

Additionally, the third operating component 92 may be independently biased between the first (raised) and second (lowered) associated positions regardless of whether the first and second operating components 90, 91 are disposed at their first or second associated positions, respectively. In this manner, the flag 50 is freely pivoted while the front door 23 and tray 96, are adapted between their respective first and second positions.

Figure 5:
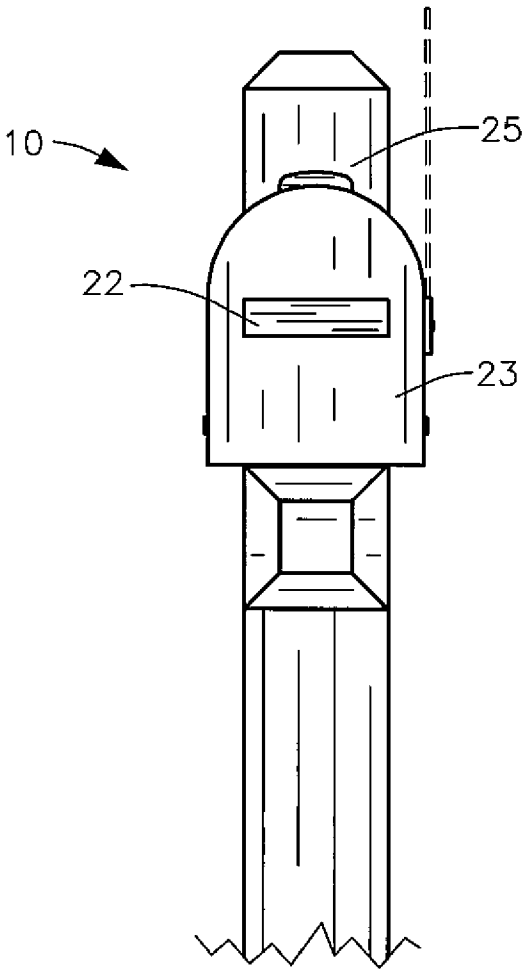
FIG. 5 is a front elevational view of the system showing the front door closed for receiving mail through the slot.
Figure 6:
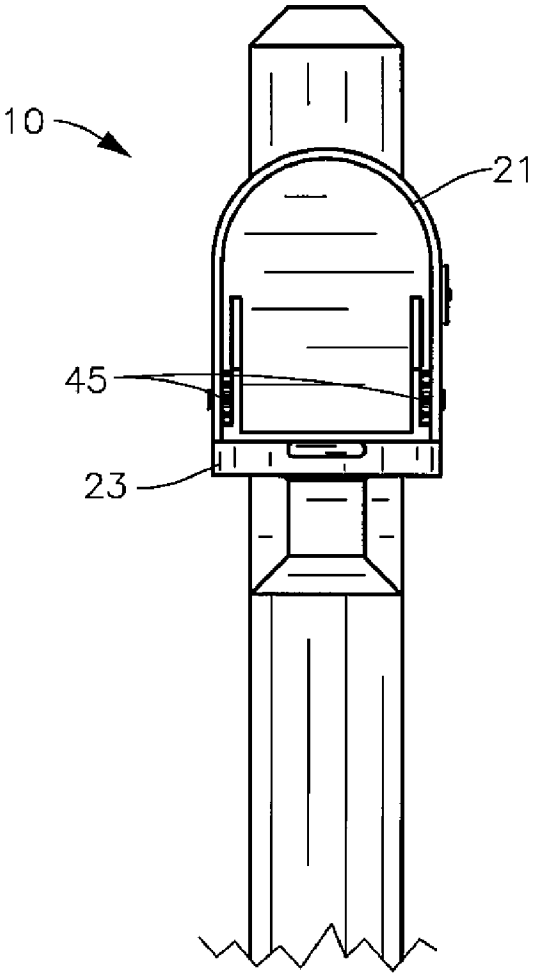
FIG. 6 is a front elevational view of the system showing the first gear set for extending the first and second pivotally mated tray members.

Referring to FIG. 5, the first operating component 90 may be provided with an elongated slot 22 for receiving mail into the housing 21. The front elongated slot 22 may be monolithically formed in the front door 23 wherein slot 22 is large enough to receive a DVD or a small collection of mail therethrough.

Figure 10:
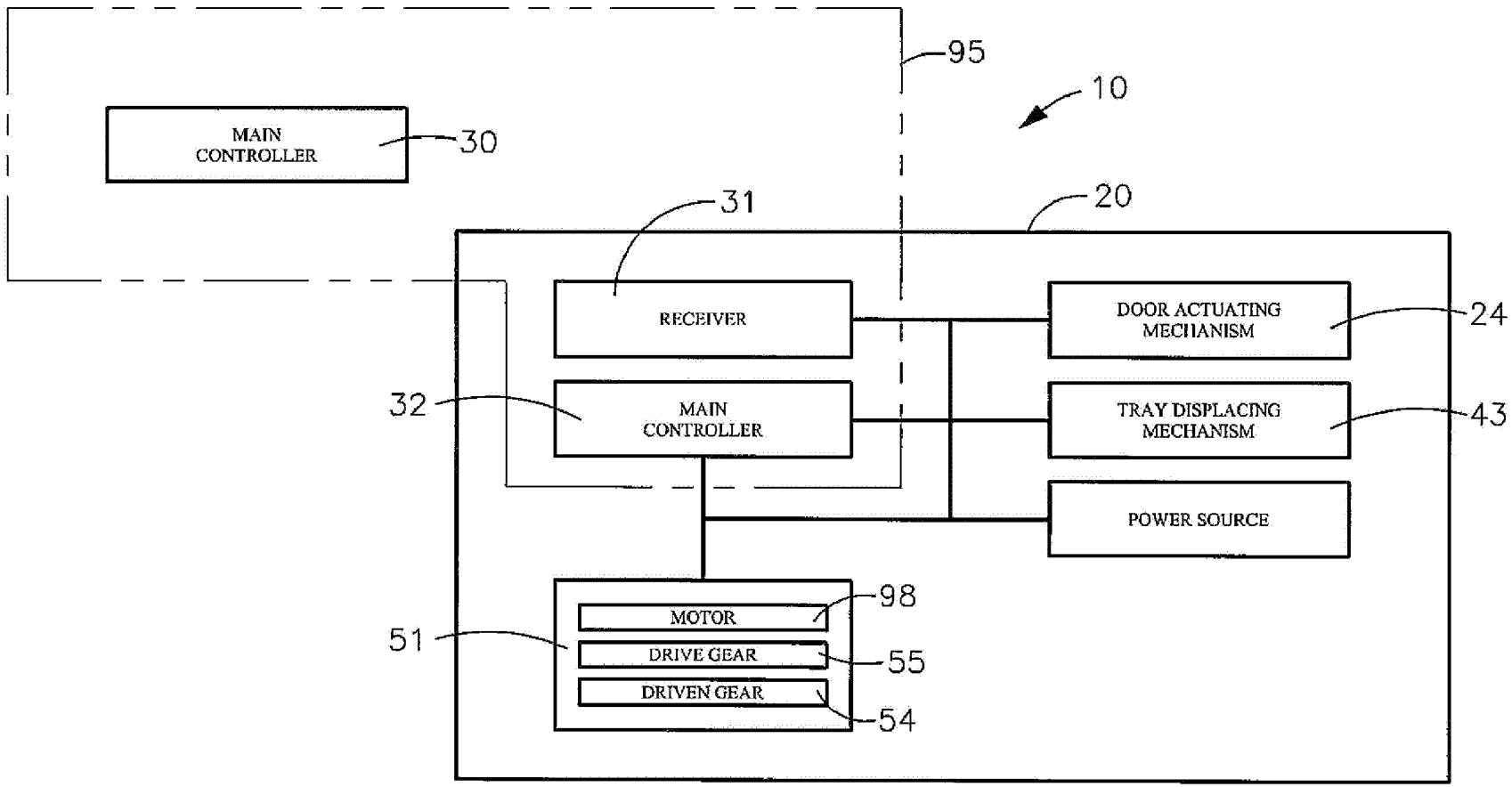
FIG. 10 is a high-level schematic block diagram showing the interrelationship between the major components of the remotely operable mailbox system.

As shown in FIG. 10, the synchronously toggling mechanism 95 may preferably have a remote controller 30 for generating and transmitting an instruction signal upon receiving a user input. The mechanism 95 may further have a receiver 31 situated inside the outdoor mailbox 20. Such a receiver 31 may be wireless communication with the remote controller 30. The main controller 32 may be electrically coupled directly to the receiver 31. In this mechanism 95, the main controller 32 preferably generates and transmits an operating signal upon receiving the instruction signal from the remote controller 30 such that that the operating signal is communicated to the first, second and third operating components 90, 91, 92, respectively.

Figure 11:
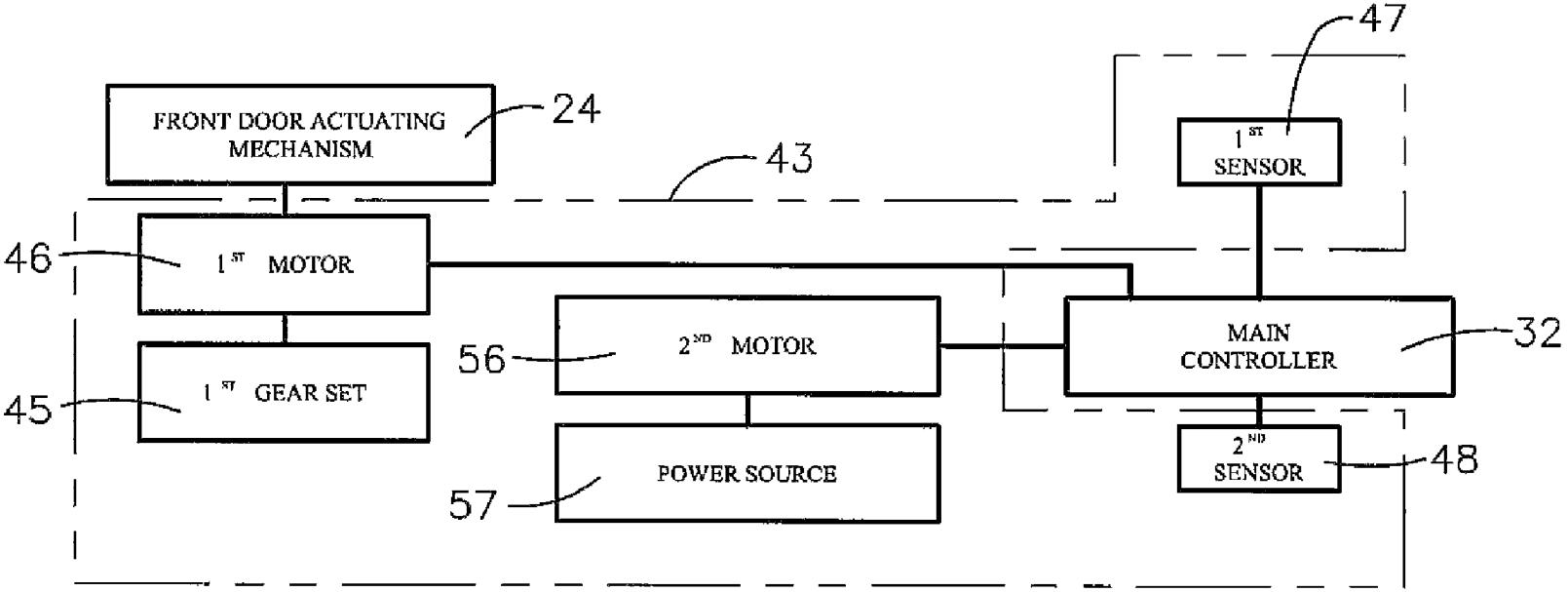
FIG. 11 is a schematic block diagram showing the interrelationship between the components of the tray displacing mechanism cooperating with the front door activation mechanism.

Referring to FIGS. 10 and 11, the remote controller 30 may be conveniently attached to a user's keychain to ensure the remote controller 30 is readily available whenever the user needs to activate the mechanism 95. In particular, mechanism 95 preferably operates by transmitting an instruction signal or the like from the remote controller 30 to the receiver 31. When a user pushes a button on the remote controller 30, a signal transmitter may in turn transmit the instruction signal to the receiver 31. After the receiver 31 has received the instruction signal, an operating signal may then be transmitted to the main controller 32. The main controller 32, in turn, transmits the operating signal to the appropriate mechanism 24, 43, 51 to manipulate the first, second and third components 90, 91, 92, respectively.

For example, when the user pushes a button on the remote controller 30 to raise the flag 50, the receiver 31 receives the instruction signal which corresponds to raising the flag. Upon receiving this instruction signal, the receiver 31 preferably sends the instruction signal to the main controller 32 which identifies the instruction signal and thereby generates and transmits an operating signal to the flag raising mechanism 51 to raise the flag 50. Likewise, the door actuating mechanism 24 and tray displacing mechanism 43 may be activated in a similar manner when their corresponding instruction signals are sent from the remote controller 30.

Figures 9, 9A:
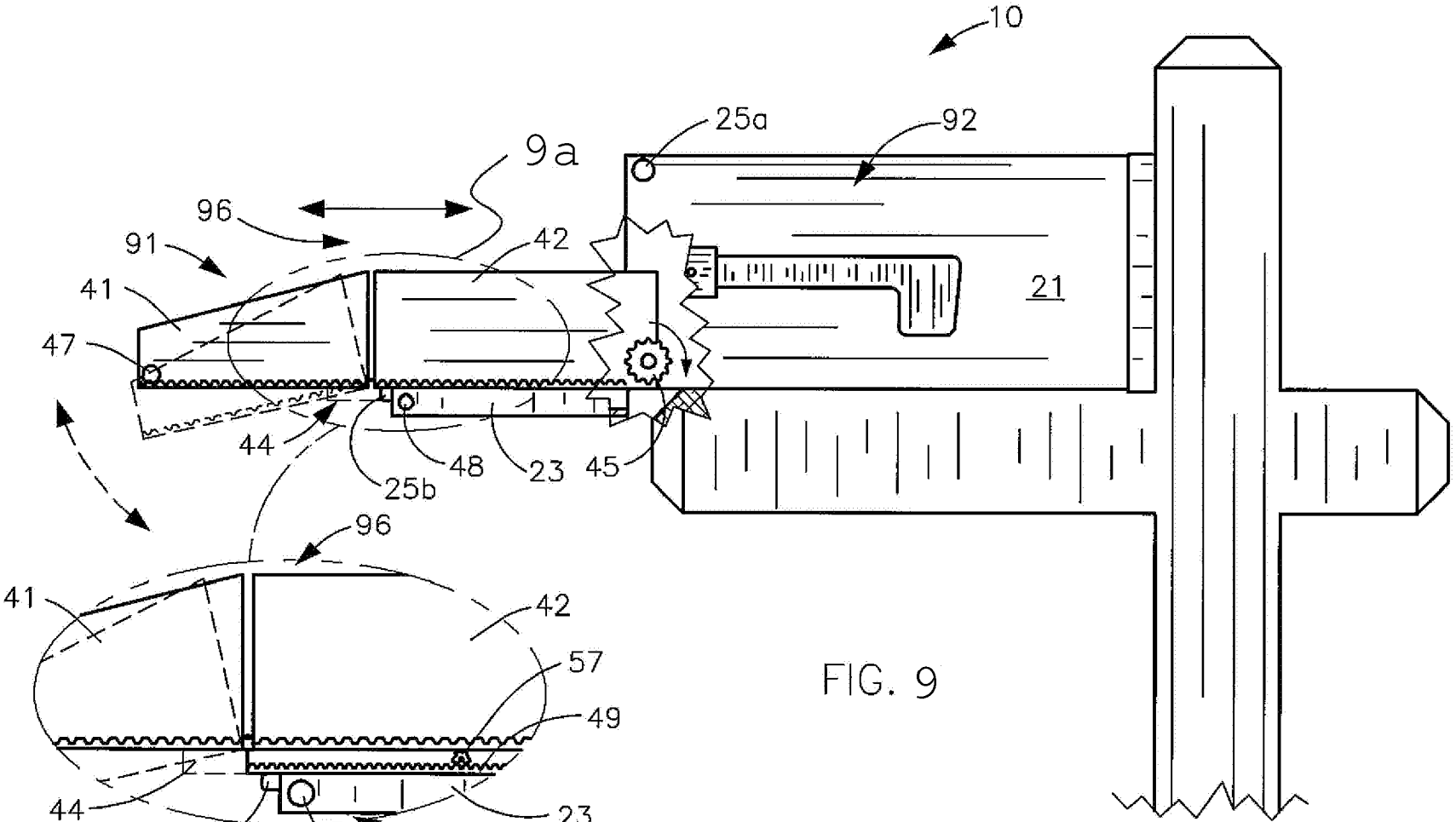
FIG. 9 is a partially exposed left side elevational view showing the tray displacing mechanism and the first and second pivotally mated tray members in the extended position.
FIG. 9*a* is an enlarged view of section 10*a* showing the gear relationship between the first set of gears and the second gear in cooperation with their respective guide tracks.

Referring back to FIGS. 1, 2, 5, 6 and 10, the first operating component 90 may include the front door 23 and the front door actuating mechanism 24. The front door may be pivotally mated to the housing 21 as well as the front door actuating mechanism 24. In this manner, mechanism 24 causes front door 23 to pivot between the first and second positions, which are preferably defined at a horizontal position 71 and a vertical position 72, respectively. Referring to FIGS. 9 and 9*a*, the front door actuating mechanism 24 may further have a lock 25 coupled to the front door 23 and the housing 21. Such a lock 25 preferably includes an upper lock portion 25*a* and a lower lock portion 25*b*, such that lock 25 may be disengaged from the housing 21 when the front door 23 is pivoted to the horizontal position.

Referring again to FIG. 2 and FIG. 4, the second operating component 91 may include tray 96 which preferably has a first tray member 41 and a second tray member 42 pivotally mated to said first tray member 41. Tray 96 is preferably oriented along an end-to-end pattern defined parallel to a longitudinal length of the housing 21. As perhaps best illustrated in FIGS. 2, 4, 8, 9 and 9*a*, tray displacing mechanism 43 may additionally be connected to tray 96 such that the first position 73 and second position 74 of tray 96 are defined interior and exterior of the housing 21, respectively.

Now referring to FIGS. 2, 4, 8, 9, 9*a* and 11 in more detail, the tray displacing mechanism 43 may have a first set of linear guide tracks 44 formed along a bottom surface of the first and second tray members 41, 42, respectively. A first set of gears 45 are rotatably engaged with the first set of linear guide tracks 44 respectively. A first motor 46 is electrically mated to the first set of gears 45 and the main controller 32. This arrangement allows the first motor 46 to be responsive to the operating signal of the main controller 32 and thereby cause the first set of gears 45 to rotate along the first set of guide tracks 44 such that each of the first and second tray members 41, 42 are linearly reciprocated between the first associated position 73 and second associated position 74, respectively.

Referring again to FIGS. 2, 4, 8, 9, 9*a* and 11, the tray displacing mechanism 43 may further have a first sensor 47 and a second sensor 48 positioned at the first tray member 41 and the lower lock portion 25*b*, respectively. A second guide track 49 may be connected to the lower lock portion 25*b* and a second gear 57 may be rotatably mated to the second guide track 49. The first sensor 47 is communicatively linked to the second sensor 48 such that the second sensor 48 notifies the main controller 32 to activate the second motor 56 after the first sensor 47 drops below the second sensor 48 while traveling away from the housing 21. This arrangement is advantageous because it overcomes the problem associated with tray member 41 being snagged against a leading edge of front door 23 as both tray members 41, 42 are retracted into the housing 21.

In response to the main controller 32, second gear 57 is caused to rotate and thereby linearly displaces the lower lock portion 25*b* away from the housing 21 while the second sensor 48 is disposed below the first sensor 47. In this way, the first tray member 41 is pivotally urged upward to a horizontal position from an angularly offset position (such as a vertical position) and thereby linearly retracts back into the housing 21 upon rotational movement of the first set of gears 45, without getting caught against the leading edge of the front door 23.

Figures 7, 7A:
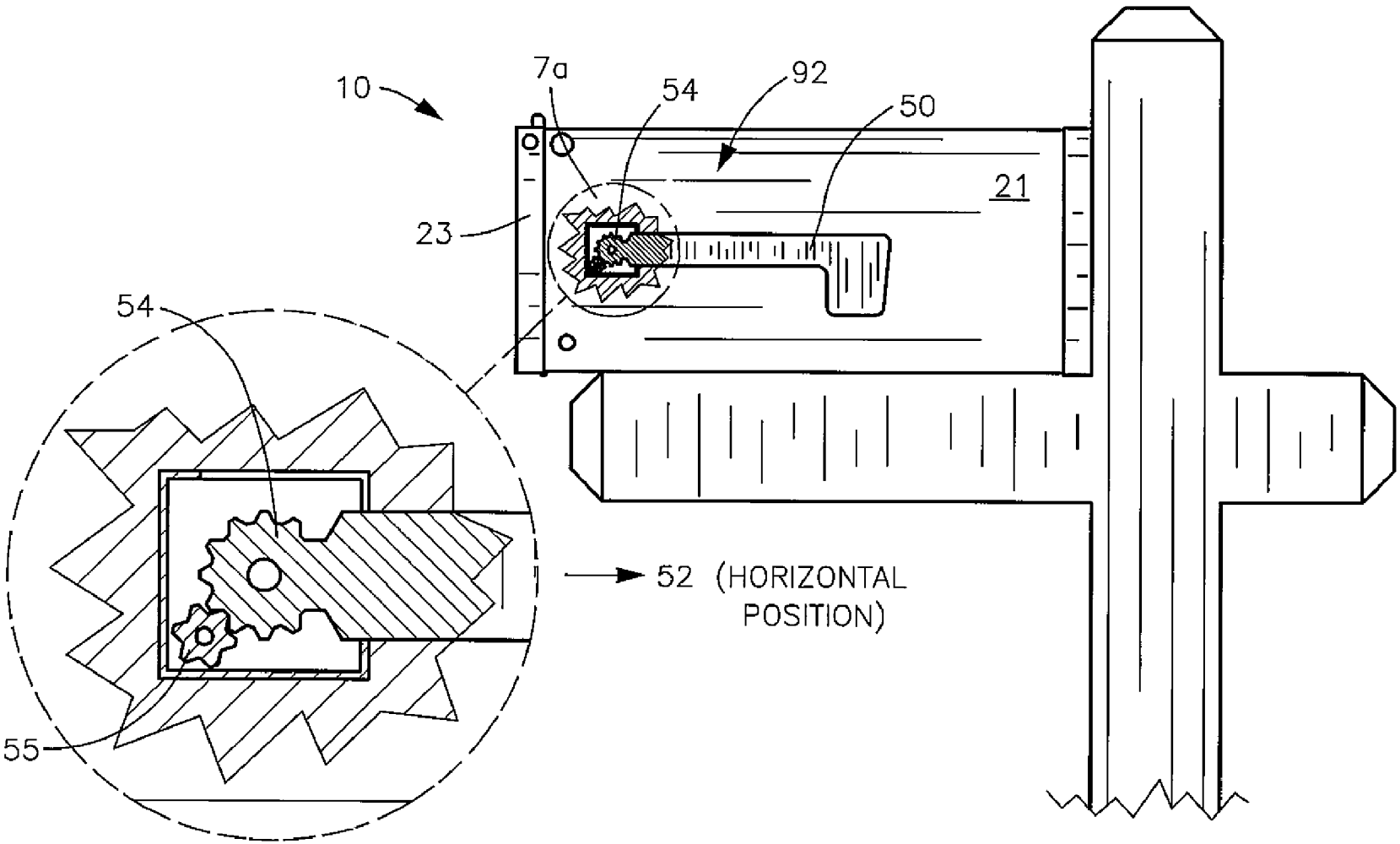
FIG. 7 is a partially exposed left side elevational view of the flag raising mechanism with the flag in its horizontal position.
FIG. 7*a* is an enlarged view of section 7*a* showing the gear relationship of the flag raising mechanism at a lowered position.
Figure 8:
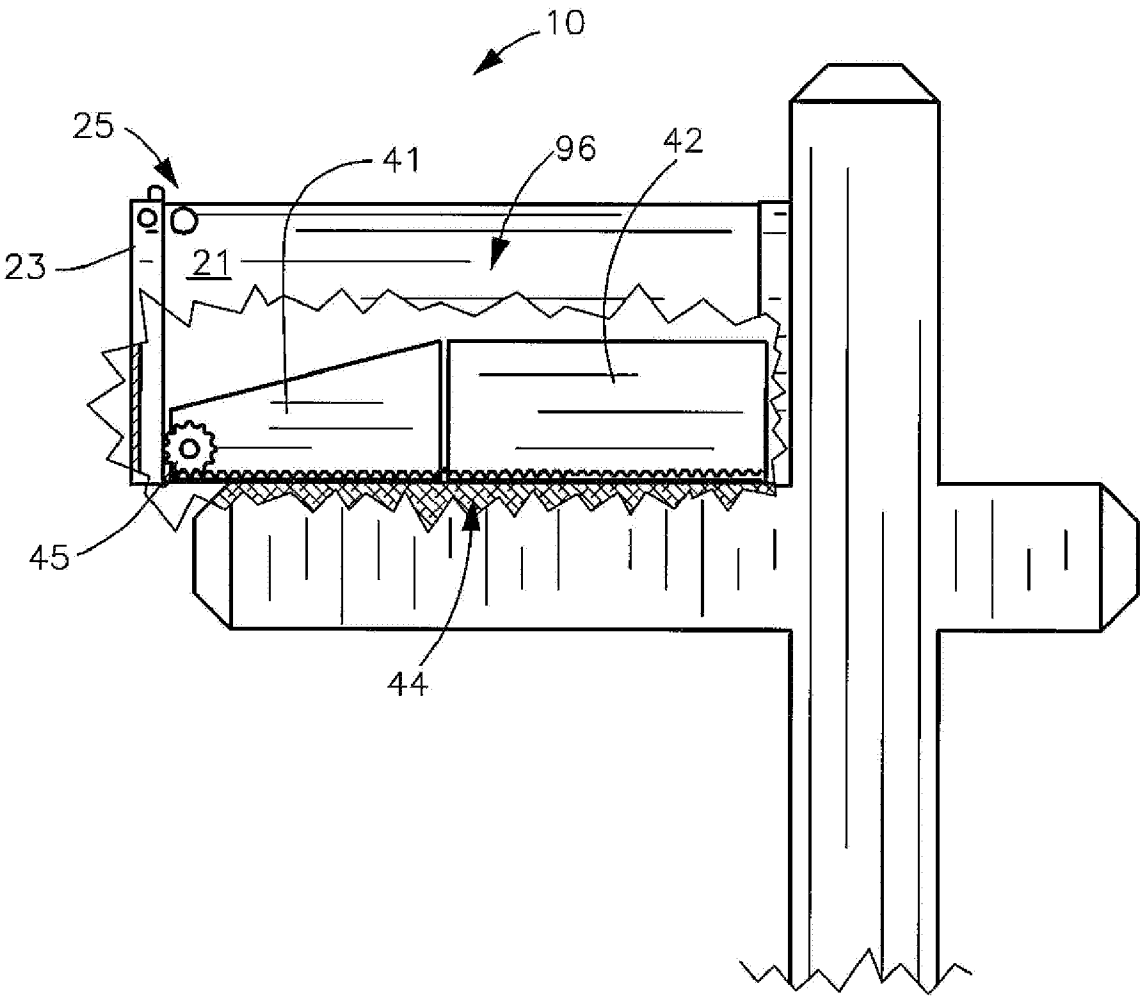
FIG. 8 is a left side elevational view showing the first and second pivotally mated tray members in a retracted position inside the housing.

Referring to FIGS. 7, 7*a*, and 10, the third operating component 92 may include flag 50 and flag raising mechanism 51. Such a mechanism 51 is preferably connected to the flag 50 and thereby pivots flag 50 between horizontal position 52 and a vertical position 53, respectively. The flag raising mechanism 51 may include a rotating driven gear 54 monolithically formed at a distal end of the flag 50, a rotating drive gear 55 interconnected to the driven gear 54, and a motor 98 communicatively coupled to the main controller 32 and drive gear 55, respectively.

In this manner, the drive gear 55 may be caused to rotate along clockwise and counterclockwise rotational directions and thereby cause the driven gear 54 to rotate reversely along counterclockwise and clockwise directions, respectively; thus causing the flag 50 to be pivoted between horizontal 52 and vertical position 53 as the driven gear 54 is rotated, respectively.

The invention may further include a method of utilizing a wireless outdoor mailbox 20 actuating system 10 and thereby effectively deterring mail and identity theft. Such a method may include the chronological steps of providing a lockable outdoor mailbox 20 having a housing 21 and a plurality of operating components 90, 91, 92 dynamically attached to the housing 21. The first operating component 90 may be provided with an elongated slot 22 for receiving mail into the housing 21.

The method may further include the chronological step of: synchronously toggling the operating components 90, 91, 92 between first and second associated positions, respectively, by performing the chronological steps of: freely biasing the first operating component 90 (front door 23 and associated mechanism 24) between the first and the second associated positions while the second operating component 91 (tray 96 and associated mechanism 43) remains seated inside the housing 21; freely reciprocating the second operating component 91 along the first and second associated positions while the first operating component 90 remains at the second associated position; independently biasing the third operating component 92 (flag 50 and associated mechanism 51) between the first and second associated positions regardless of whether the first and second operating components 90, 91 are disposed at the first or second associated positions, respectively.

The present invention, as claimed, provides the unexpected and unpredictable benefit of providing a wireless outdoor mailbox actuating system for providing users with an effective way of preventing unauthorized access to private mail while quickly retracting tray members 41, 42 between extracted and retracted positions without requiring a user to exit their vehicle to manually push tray members 41, 42 back into the housing 21. Accessed only by the owner's remote controller after mail has been delivered, the present invention ensures that private and sensitive documents, personal correspondence and expensive parcels do not fall into the hands of crafty thieves. The combination of such claimed elements provides an unpredictable and unexpected result which is not rendered obvious by one skilled in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A wireless outdoor mailbox actuating system for effectively deterring mail and identity theft, said wireless outdoor mailbox actuating system comprising:

a lockable outdoor mailbox including a housing, and a plurality of operating components dynamically attached to said housing; and wireless means for synchronously toggling said plurality of operating components between first and second associated positions respectively;

wherein a first operating component of said plurality of operating components is freely biased between said first and said second associated positions while said second operating component remains seated inside said housing;

wherein a second operating component of said plurality of operating components is freely reciprocated along said first and second associated positions while said first operating component remains at said second associated position;

wherein a third operating component of said plurality of operating components is independently biased between said first and second associated positions regardless of whether said first and second operating components are disposed at said first or second associated positions respectively.

2. The wireless mailbox actuating system of claim 1, wherein said wireless synchronously toggling means comprises:

a remote controller for generating and transmitting an instruction signal upon receiving a user input;

a receiver situated inside said outdoor mailbox and being in wireless communication with said remote controller; and a main controller electrically coupled directly to said receiver, said main controller generating and transmitting an operating signal upon receiving said instruction signal from said remote controller;

wherein said operating signal is communicated to said first, second and third operating components respectively.

3. The wireless mailbox actuating system of claim 2, wherein said first operating component comprises:

a front door pivotally mated to said housing; and a front door actuating mechanism connected to said front door;

wherein said first and second positions of said front door are defined at horizontal and vertical positions respectively.

4. The wireless mailbox actuating system of claim 3, wherein said front door actuating mechanism comprises: a lock coupled to said front door and said housing respectively, said lock being disengaged from said housing when said front door is pivoted to said horizontal position.

5. The wireless mailbox actuating system of claim 4, wherein said second operating component comprises:

a tray including first and second pivotally mated tray members oriented along an end-to-end pattern defined parallel to a longitudinal length of said housing; and a tray displacing mechanism connected to said tray;

wherein said first and second positions of said tray are defined interior and exterior of said housing respectively.

6. The wireless mailbox actuating system of claim 5, wherein said tray displacing mechanism comprises:

a first set of linear guide tracks formed along a bottom surface of said first and second tray members respectively;

a first set of gears rotatably engaged with said first set of linear guide tracks respectively; and a first motor electrically mated to said first set of gears;

wherein said first motor is responsive to said operating signal of said main controller and thereby causes said first set of gears to rotate along said first set of guide tracks such that each of said first and second tray members are linearly reciprocated between said first and second associated positions respectively.

7. The wireless mailbox actuating system of claim 6, wherein said tray displacing mechanism further comprises:

first and second sensors positioned at said first tray member and said lock respectively;

a second guide track connected to said lock; and a second gear rotatably mated to said second guide track;

wherein said first sensor is communicatively linked to said second sensor such that said second sensor notifies said main controller to activate said second motor after said first sensor drops below said second sensor while traveling away from said housing;

wherein said second gear rotates and thereby linearly displaces said lock away from said housing while said second sensor is disposed below said first sensor;

wherein said first tray member is pivotally urged upward to a horizontal position from a vertical position and thereby linearly retracts back into said housing upon rotational movement of said first set of gears respectively.

8. The wireless mailbox actuating system of claim 7, wherein said third operating component comprises:

a flag; and a flag raising mechanism connected to said flag;

wherein said first and second associated positions of said flag are defined at horizontal and vertical positions respectively.

9. The wireless mailbox actuating system of claim 8, wherein said flag raising mechanism comprises:

a rotating driven gear monolithically formed at a distal end of said flag;

a rotating drive gear interconnected to said driven gear; and a motor communicatively coupled to said main controller and said drive gear respectively;

wherein said drive gear is caused to rotate along clockwise and counter clockwise rotational directions and thereby causes said driven gear to rotate along counter clockwise and clockwise directions respectively;

wherein said flag is pivoted between said horizontal and vertical positions as said driven gear is rotated respectively.

10. A wireless outdoor mailbox actuating system for effectively deterring mail and identity theft, said wireless outdoor mailbox actuating system comprising:

a lockable outdoor mailbox including a housing, and a plurality of operating components dynamically attached to said housing; and wireless means for synchronously toggling said plurality of operating components between first and second associated positions respectively;

wherein a first operating component of said plurality of operating components is freely biased between said first and said second associated positions while said second operating component remains seated inside said housing;

wherein a second operating component of said plurality of operating components is freely reciprocated along said first and second associated positions while said first operating component remains at said second associated position;

wherein a third operating component of said plurality of operating components is independently biased between said first and second associated positions regardless of whether said first and second operating components are disposed at said first or second associated positions respectively;

wherein said first operating component is provided with an elongated slot for receiving mail therethrough and into said housing.

11. The wireless mailbox actuating system of claim 10, wherein said wireless synchronously toggling means comprises:

a remote controller for generating and transmitting an instruction signal upon receiving a user input;

a receiver situated inside said outdoor mailbox and being in wireless communication with said remote controller; and a main controller electrically coupled directly to said receiver, said main controller generating and transmitting an operating signal upon receiving said instruction signal from said remote controller;

wherein said operating signal is communicated to said first, second and third operating components respectively.

12. The wireless mailbox actuating system of claim 11, wherein said first operating component comprises:

a front door pivotally mated to said housing; and a front door actuating mechanism connected to said front door;

wherein said first and second positions of said front door are defined at horizontal and vertical positions respectively.

13. The wireless mailbox actuating system of claim 12, wherein said front door actuating mechanism comprises: a lock coupled to said front door and said housing respectively, said lock being disengaged from said housing when said front door is pivoted to said horizontal position.

14. The wireless mailbox actuating system of claim 13, wherein said second operating component comprises:

a tray including first and second pivotally mated tray members oriented along an end-to-end pattern defined parallel to a longitudinal length of said housing; and a tray displacing mechanism connected to said tray;

wherein said first and second positions of said tray are defined interior and exterior of said housing respectively.

15. The wireless mailbox actuating system of claim 14, wherein said tray displacing mechanism comprises:

a first set of linear guide tracks formed along a bottom surface of said first and second tray members respectively;

a first set of gears rotatably engaged with said first set of linear guide tracks respectively; and a first motor electrically mated to said first set of gears;

wherein said first motor is responsive to said operating signal of said main controller and thereby causes said first set of gears to rotate along said first set of guide tracks such that each of said first and second tray members are linearly reciprocated between said first and second associated positions respectively.

16. The wireless mailbox actuating system of claim 15, wherein said tray displacing mechanism further comprises:

first and second sensors positioned at said first tray member and said lock respectively;

a second guide track connected to said lock; and a second gear rotatably mated to said second guide track;

wherein said first sensor is communicatively linked to said second sensor such that said second sensor notifies said main controller to activate said second motor after said first sensor drops below said second sensor while traveling away from said housing;

wherein said second gear rotates and thereby linearly displaces said lock away from said housing while said second sensor is disposed below said first sensor;

wherein said first tray member is pivotally urged upward to a horizontal position from a vertical position and thereby linearly retracts back into said housing upon rotational movement of said first set of gears respectively.

17. The wireless mailbox actuating system of claim 16, wherein said third operating component comprises:

a flag; and a flag raising mechanism connected to said flag;

wherein said first and second associated positions of said flag are defined at horizontal and vertical positions respectively.

18. The wireless mailbox actuating system of claim 17, wherein said flag raising mechanism comprises:

a rotating driven gear monolithically formed at a distal end of said flag;

a rotating drive gear interconnected to said driven gear; and a motor communicatively coupled to said main controller and said drive gear respectively;

wherein said drive gear is caused to rotate along clockwise and counter clockwise rotational directions and thereby causes said driven gear to rotate along counter clockwise and clockwise directions respectively;

wherein said flag is pivoted between said horizontal and vertical positions as said driven gear is rotated respectively.

19. A method of utilizing a wireless outdoor mailbox actuating system and thereby effectively deterring mail and identity theft, said method comprising the chronological steps of:

providing a lockable outdoor mailbox including a housing and a plurality of operating components dynamically attached to said housing; and providing a wireless means for synchronously toggling said operating components between first and second associated positions respectively by performing the following chronological steps freely biasing a first operating component of said plurality of operating components between said first and said second associated positions while said second operating component remains seated inside said housing, freely reciprocating a second operating component of said plurality of operating components along said first and second associated positions while said first operating component remains at said second associated position, and independently biasing a third operating component of said plurality of operating components between said first and second associated positions regardless of whether said first and second operating components are disposed at said first or second associated positions respectively;

wherein said first operating component is provided with an elongated slot for receiving mail therethrough and into said housing.

* * * * *